US008684683B2

(12) United States Patent
Brunt et al.

(10) Patent No.: US 8,684,683 B2
(45) Date of Patent: Apr. 1, 2014

(54) GAS TURBINE NOZZLE ATTACHMENT SCHEME AND REMOVAL/INSTALLATION METHOD

(75) Inventors: Thomas James Brunt, Mauldin, SC (US); Robert Walter Coign, Piedmont, SC (US); Gregory Thomas Foster, Greer, SC (US)

(73) Assignee: General Electric Company, Schenectady, NY (US)

( * ) Notice: Subject to any disclaimer, the term of this patent is extended or adjusted under 35 U.S.C. 154(b) by 792 days.

(21) Appl. No.: 12/956,554

(22) Filed: Nov. 30, 2010

(65) Prior Publication Data

US 2012/0134791 A1 May 31, 2012

(51) Int. Cl.
*F01D 9/04* (2006.01)
*F01D 25/24* (2006.01)

(52) U.S. Cl.
USPC ..... 415/189; 415/190; 415/209.2; 29/889.1; 29/889.2; 29/889.22; 29/402.01; 29/402.03; 29/402.08; 29/426.1; 29/426.2; 29/525.11

(58) Field of Classification Search
CPC ..... F01D 9/04; F01D 9/041; F01D 9/042; F01D 25/246; F05B 2240/123; F05B 2240/12; B23P 15/00; B23P 15/006; B23P 15/04
USPC ..... 415/138–139, 189–190, 209.2, 209.3, 415/209.4, 210.1; 29/889.1, 889.2, 889.22, 29/402.01, 402.03–402.21, 426.1, 426.2, 29/525.01, 525.11
See application file for complete search history.

(56) References Cited

U.S. PATENT DOCUMENTS

| | | | | |
|---|---|---|---|---|
| 3,829,233 | A * | 8/1974 | Scalzo et al. | 415/110 |
| 4,511,306 | A * | 4/1985 | Hultgren | 415/190 |
| 4,883,405 | A | 11/1989 | Walker | |
| 5,441,385 | A | 8/1995 | Boyd et al. | |
| 5,618,161 | A | 4/1997 | Papageorgiou et al. | |
| 5,653,580 | A | 8/1997 | Faulder et al. | |
| 6,095,750 | A | 8/2000 | Ross et al. | |
| 6,375,415 | B1 | 4/2002 | Burdgick | |
| 7,094,025 | B2 | 8/2006 | Arness et al. | |
| 7,160,078 | B2 | 1/2007 | Coign et al. | |
| 2007/0154305 | A1 * | 7/2007 | Arness et al. | 415/209.2 |

* cited by examiner

*Primary Examiner* — Christopher Verdier
(74) *Attorney, Agent, or Firm* — Nixon & Vanderhye P.C.

(57) ABSTRACT

A turbine nozzle attachment assembly includes an outer turbine component (a shroud or a turbine shell) formed with a circumferential groove open in a forward-facing axial direction; a nozzle segment including a vane extending between inner and outer bands, the outer band provided with an upstanding annular hook formed with a hook element extending in an aft-facing axial direction and received in the circumferential groove. The upstanding annular hook and hook element are formed with a circumferentially-oriented slot. An anti-rotation block is located in the circumferentially-oriented slot, and an anti-tipping plate having a circumferential width greater than a corresponding circumferential width of the circumferentially-oriented slot substantially covers a forward face of the anti-rotation block. The anti-rotation block and the anti-tipping plate are fastened directly to the outer turbine component.

19 Claims, 4 Drawing Sheets

GAS TURBINE NOZZLE ATTACHMENT SCHEME AND REMOVAL/INSTALLATION METHOD

BACKGROUND OF THE INVENTION

The present invention relates to an apparatus and a method for preventing rotation of a nozzle segment in a gas turbine while also facilitating removal and replacement/installation of a selected nozzle segment without having to remove the upper turbine shell or casing.

In gas turbines, individual nozzle stages are typically formed by an annular array of nozzle segments spaced circumferentially one from the other about the axis of the turbine. For example, in a simply supported nozzle segment design (for example, in a turbine first stage), the nozzle segments each include outer and inner bands with one or more nozzle vanes extending therebetween, and with mounting constraints at the inner and outer bands. Oftentimes, however, it is necessary to remove the upper or outer turbine shell in order to gain access to and remove a sample or damaged nozzle segment for testing and/or repair or replacement. Therefore, there is a need to generally improve the capability for removing and installing one or more selected nozzle segments to facilitate maintenance and/or testing operations.

BRIEF SUMMARY OF THE INVENTION

In one exemplary but nonlimiting embodiment, the invention relates to a turbine nozzle attachment assembly for a turbine comprising an outer turbine component formed with a circumferential groove open in a forward-facing axial direction; a nozzle segment including a vane extending between inner and outer bands, the outer band provided with an upstanding annular hook formed with a hook element extending in an aft-facing axial direction, the hook element received in the circumferential groove, the upstanding annular hook and the hook element formed with a circumferentially-oriented slot; an anti-rotation block located in the circumferentially-oriented slot; and an anti-tipping plate having a circumferential width greater than a corresponding circumferential width of the circumferentially-oriented slot, the anti-tipping plate substantially covering a forward face of the anti-rotation block; and wherein the anti-rotation block and the anti-tipping plate are fastened directly to the outer shroud.

In still another exemplary but nonlimiting embodiment, the invention relates to a turbine nozzle and shroud attachment assembly comprising an outer shroud formed with a circumferential groove open in a forward-facing axial direction; a nozzle segment including a vane extending between inner and outer bands, said outer band provided with an upstanding annular hook formed with a radially-oriented stem connected to a hook element extending in an aft-facing axial direction, the hook element received in the circumferential groove, the upstanding annular hook and the hook element formed with a circumferentially-oriented slot; an anti-rotation block located in the circumferentially-oriented slot; an anti-tipping plate having a circumferential width greater than a corresponding circumferential width of the circumferentially-oriented slot, the anti-tipping plate substantially covering a forward face of the anti-rotation block and engaged with the upstanding annular hook; and wherein the anti-rotation block and the anti-tipping plate are fastened directly to the outer shroud; wherein said circumferentially-oriented slot is defined by a pair of opposed parallel faces of the upstanding annular hook and a circumferentially-extending base surface formed in the stem between the pair of opposed parallel faces; and wherein, upon installation and prior to operation, the anti-rotation block is not engaged with the upstanding annular hook.

In still another aspect, the invention relates to a method of installing a nozzle segment of a first stage row of nozzle segments arranged in a turbine component surrounding a rotor wheel such that said nozzle segment is prevented from rotating or tipping relative to said turbine component, the method comprising providing an outer turbine component formed with a circumferential groove open in a forward-facing axial direction; providing a nozzle segment including a vane extending between inner and outer bands, the outer band provided with an upstanding annular hook formed with a hook element extending in an aft-facing axial direction, the hook element received in the circumferential groove; forming the upstanding annular hook and the hook element with a circumferentially-oriented slot; locating an anti-rotation block in said circumferentially-oriented slot; locating an anti-tipping plate having a circumferential width greater than a corresponding circumferential width of the circumferentially-oriented slot, over a forward face of the anti-rotation block; and securing the anti-rotation block and the anti-tipping plate directly to the outer turbine component.

The invention will now be described in connection with the drawings identified below.

DETAILED DESCRIPTION OF THE INVENTION

Figure 1:
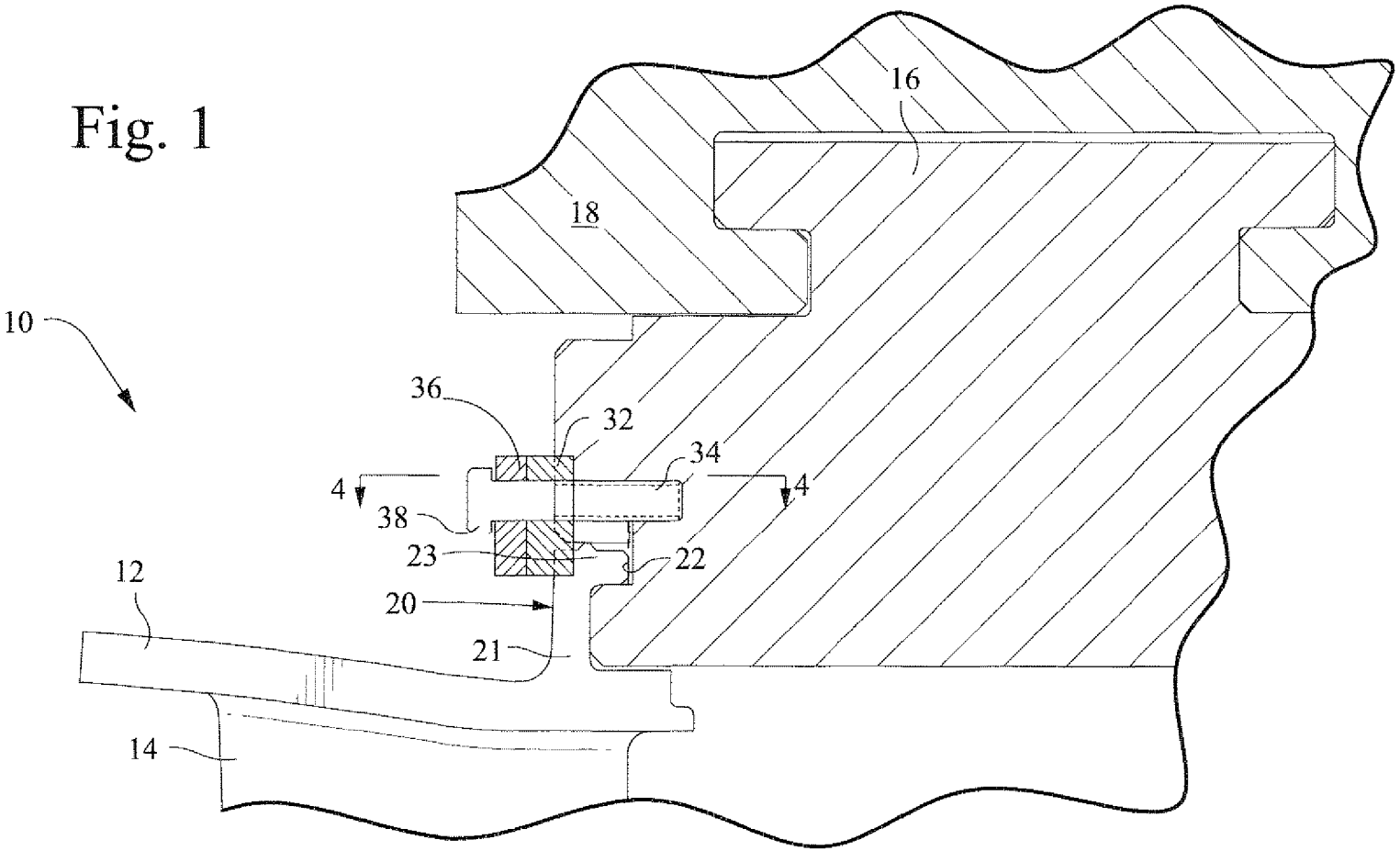
FIG. 1 is a side elevation, partly in cross section of a turbine blade tip and an anti-rotation device in accordance with an exemplary but nonlimiting embodiment.

Referring to FIG. 1, there is illustrated a nozzle segment (or nozzle), generally designated 10, and including an outer band or platform 12, an inner band (not shown) and one or more nozzle vanes 14 extending between the outer and inner bands. In the example embodiment of this invention, there is only one nozzle vane per segment. The outer band of the nozzle segment is secured to an outer turbine component such as the shroud 16 which, in turn, is attached to the inner turbine shell 18. It will be appreciated, however, that the outer band of the nozzle could be fixed directly to the turbine inner shell 18. The outer band or platform 12 is formed with an upstanding annular machined hook 20 that is received within a mated slot 22 in the shroud 16. The upstanding annular hook 20 includes a radially projecting stem 21 and an axially-oriented hook element 23 extending in an aft direction.

Figure 2:
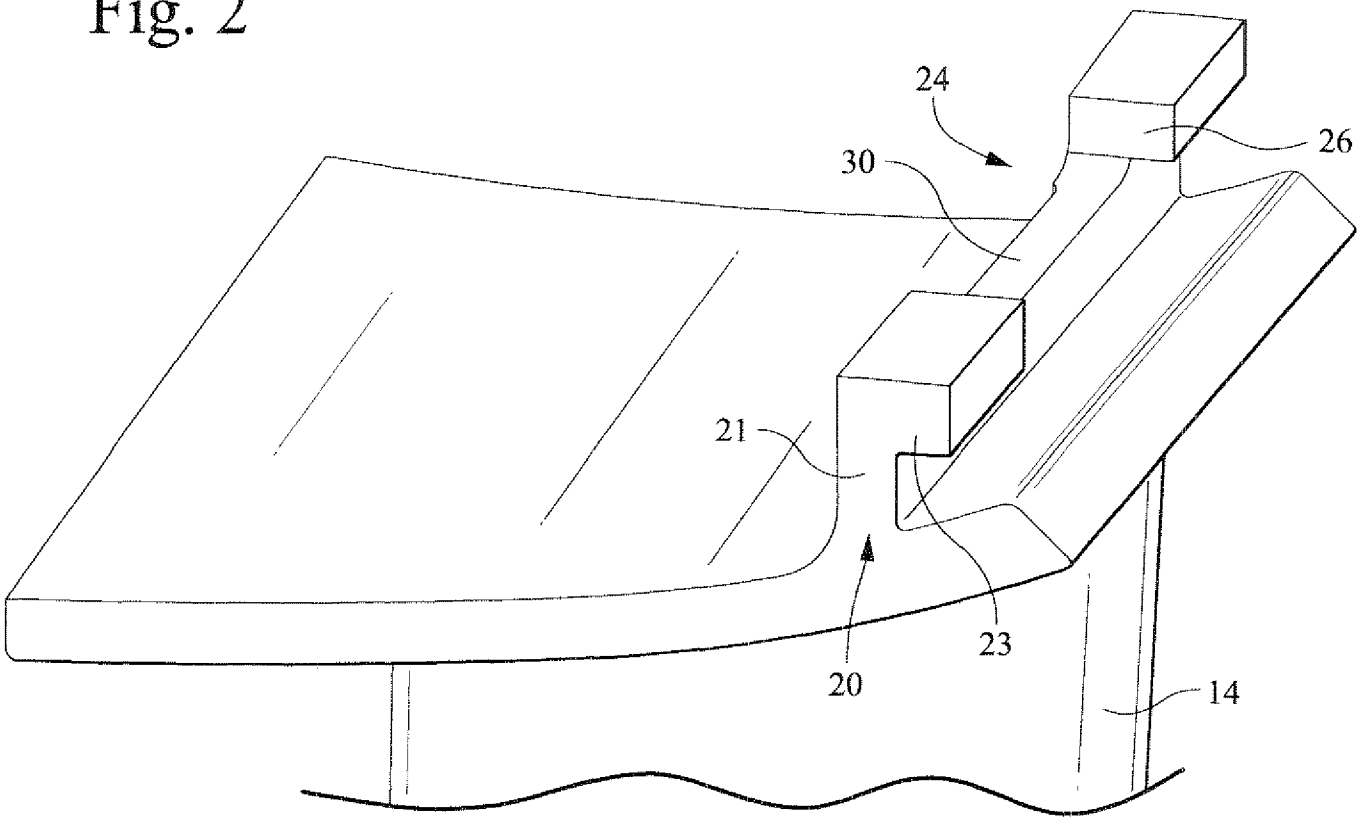
FIG. 2 is a partial perspective view of the turbine blade tip of FIG. 1 with the anti-rotation block removed.
Figure 3:
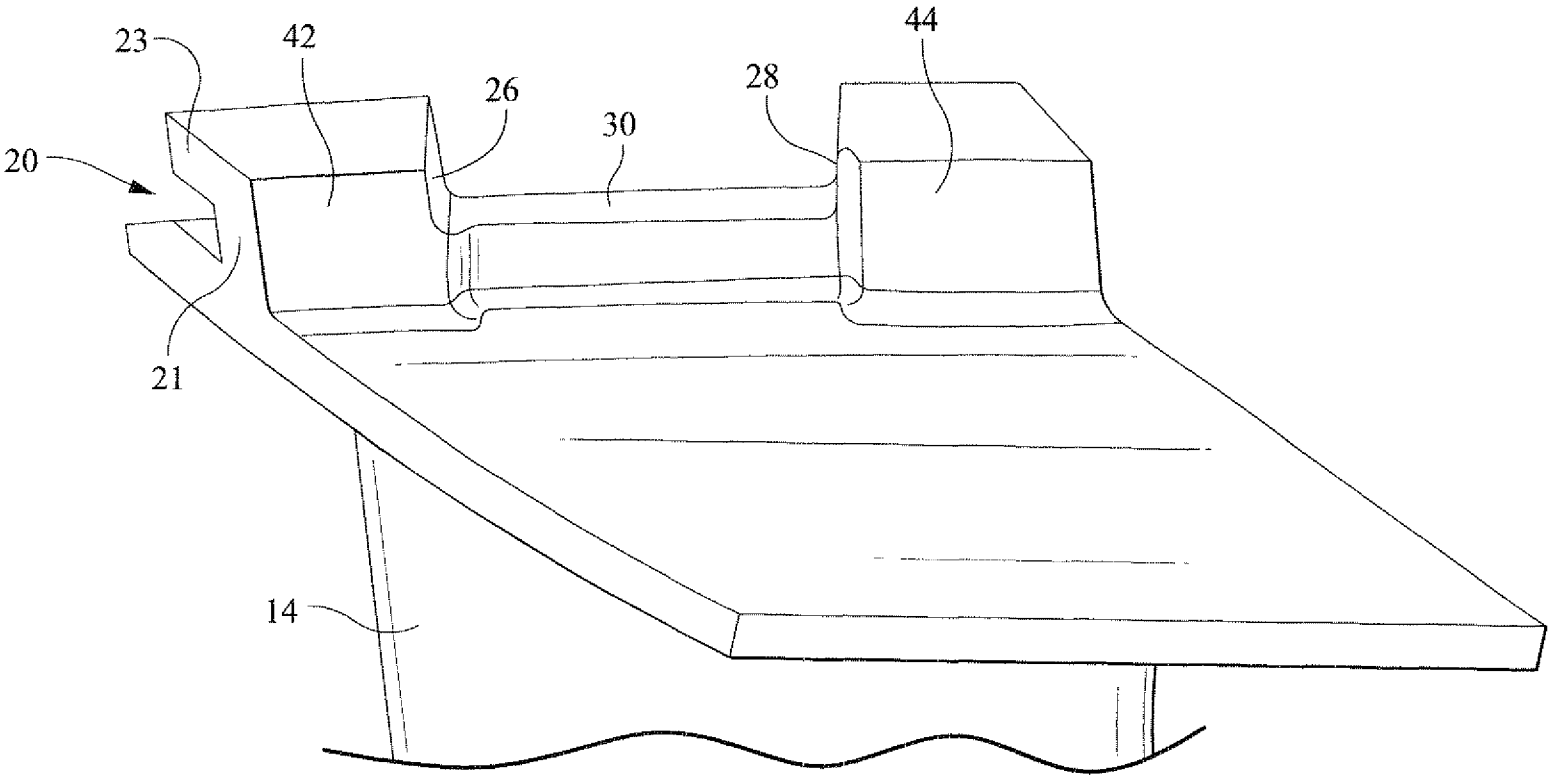
FIG. 3 is a left side perspective view of the turbine blade tip shown in FIG. 2.

As best seen in FIGS. 2 and 3, the annular hook 20 on the outer band 12 is interrupted by a circumferentially-extending slot or recess 24 defined in part by two opposed face surfaces 26, 28 connected by a raised, substantially flat circumferentially extending stem surface 30.

Figure 5:
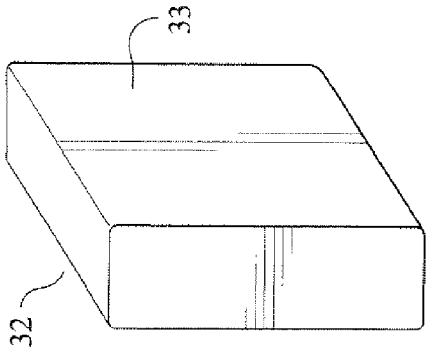
FIG. 5 is a perspective view of an anti-rotation block removed from FIG. 1.
Figure 4:
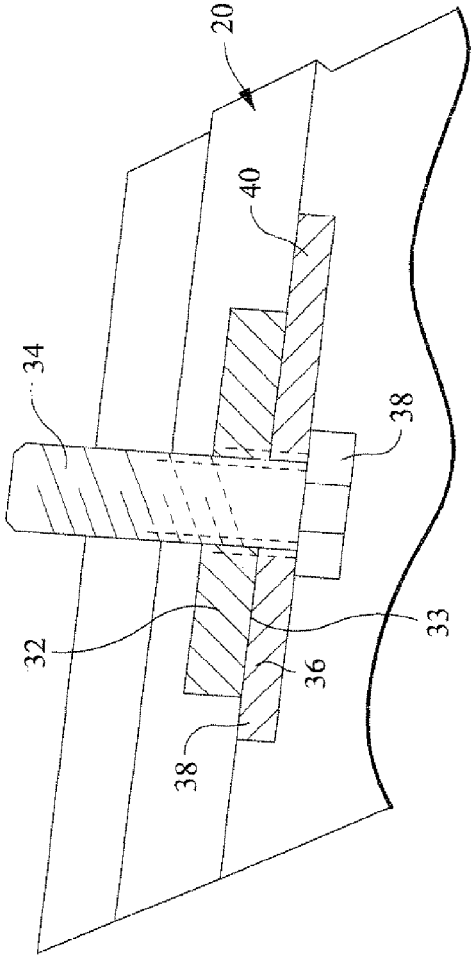
FIG. 4 is a top plan view of the bucket and anti-rotation device shown in FIG. 1.

An anti-rotation block 32 (FIGS. 1, 4 and 5) is adapted to be received in the recess 24 in the outer band, with clearances, initially, between the block and the opposed faces 26, 28 and stem surface 30. The anti-rotation block 32 is also received in a recess formed in the shroud 16 as seen in FIG. 1. While the block 32 is shown to be rectangular in shape, the block could be wedge-shaped, cylindrical or another suitable shape.

Figure 6:
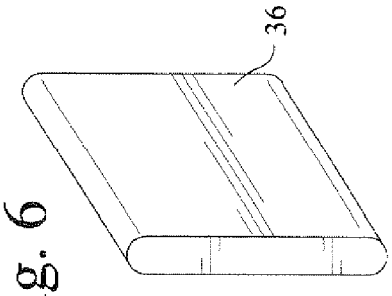
FIG. 6 is a perspective view of an anti-tipping plate taken from FIG. 1.

An anti-tipping plate 36 (FIGS. 1, 4 and 6), having a circumferential width dimension greater than the width of the recess 24 is applied over the forward face 33 of the anti-rotation block, and both the block 32 and anti-tipping plate 36 are bolted directly to the shroud by means of one or more bolts 34. Thus, the end portions 38, 40 of the anti-tipping plate 36 engage surfaces 42, 44 (FIG. 3) of the hook 20. The anti-tipping plate can be substantially rectangular in shape.

In use, the anti-rotation block 32 will react out the circumferential component of the gas path pressure loads on the surface 26, but clearances will be maintained between the anti-rotation block 32 and surfaces 28 and 30. At the same time, it will be apparent that the anti-rotation block 32 prevents circumferential rotation of the nozzle segment relative to the shroud 16.

The purpose of the anti-tipping plate 36 is to prevent an individual nozzle segment, and specifically the hook element 23 from disengaging from the groove or slot 22 in the downstream shroud during the installation of the turbine shell. In this regard, the first stage nozzle segments have no forward-facing hooks, giving rise to the potential tipping of the segments out of the slot 22. Where tipping is not a concern, the anti-rotation block may be used by itself to prevent rotation.

At the same time, the above-described arrangement allows for individual nozzle segments to be removed from the gas turbine during an outage without requiring removal of the upper half of the turbine shell or casing. With the present arrangement, one or more selected nozzle segments may be removed through an opening created when the upstream combustor hardware is removed as described in detail below.

For example, during an outage, the anti-rotation block and anti-tipping plate 36 of, for example, a damaged nozzle segment and a selected number of adjacent nozzle segments will be removed. The anti-tipping plates, however, will be immediately reinstalled in order to prevent the nozzle hooks 20 of the selected segments from becoming disengaged from (or tipping out of) the shroud slot 24. The nozzle segments may now be shifted circumferentially until a gap large enough to remove the intersegment seals (not shown) of the damaged segment nozzle. Once the seals are removed, the anti-tipping plate of the damaged segment is unbolted and the damaged segment removed through the combustor opening. Replacement or reinstallation is carried out in a reversal of the above-described removal procedure.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A turbine nozzle attachment assembly for a turbine comprising:

an outer turbine component formed with a circumferential groove open in a forward-facing axial direction;

a nozzle segment including a vane extending between inner and outer bands, said outer band provided with an upstanding annular hook formed with a hook element extending in an aft-facing axial direction, said hook element received in said circumferential groove, said upstanding annular hook and said hook element formed with a circumferentially-oriented slot;

an anti-rotation block located in said circumferentially-oriented slot; and an anti-tipping plate having a circumferential width greater than a corresponding circumferential width of said circumferentially-oriented slot, said anti-tipping plate substantially covering a forward face of said anti-rotation block; and wherein said anti-rotation block and said anti-tipping plate are fastened directly to said outer turbine component.

2. The turbine nozzle attachment assembly of claim 1, wherein, upon installation and prior to operation, said anti-rotation block is not engaged with said upstanding annular hook.

3. The turbine nozzle attachment assembly of claim 1 wherein said upstanding annular hook includes a radially extending stem connected to said hook element, and wherein said circumferentially-oriented slot is defined by a pair of opposed parallel faces of said upstanding annular hook and a circumferentially-extending base surface formed in said stem between said pair of opposed parallel faces.

4. The turbine nozzle attachment assembly of claim 3 wherein, during operation, said anti-rotation block is engaged with one of said opposed parallel faces of said upstanding annular hook.

5. The turbine nozzle attachment assembly of claim 1 wherein said outer turbine component comprises a shroud attached to an inner shell of the turbine.

6. The turbine nozzle attachment assembly of claim 1 wherein said anti-tipping plate is substantially rectangular in shape, and wherein said anti-rotation block has a thickness greater than a corresponding thickness of said anti-tipping plate.

7. A turbine nozzle and shroud attachment assembly comprising:

an outer shroud formed with a circumferential groove open in a forward-facing axial direction;

a nozzle segment including a vane extending between inner and outer bands, said outer band provided with an upstanding annular hook formed with a radially-oriented stem connected to a hook element extending in an aft-facing axial direction, said hook element received in said circumferential groove, said upstanding annular hook and said hook element formed with a circumferentially-oriented slot defined by a pair of opposed parallel faces of said upstanding annular hook and a circumferentially-extending base surface formed in said stem between said pair of opposed parallel faces;

an anti-rotation block located in said circumferentially-oriented slot;

an anti-tipping plate having a circumferential width greater than a corresponding circumferential width of said circumferentially-oriented slot, said anti-tipping plate substantially covering a forward face of said anti-rotation block and engaged with said upstanding annular hook; and wherein said anti-rotation block and said anti-tipping plate are fastened directly to said outer shroud; and wherein, upon installation and prior to operation, said anti-rotation block is not engaged with said upstanding annular hook.

8. The turbine nozzle and shroud attachment assembly of claim 7 wherein, during operation, said anti-rotation block is engaged with one of said opposed parallel faces of said upstanding annular hook.

9. The turbine nozzle and shroud attachment assembly of claim 8 wherein said outer shroud is attached to a shell of a turbine.

10. A method of installing a nozzle segment of a first stage row of nozzle segments arranged in a turbine component surrounding a rotor wheel such that said nozzle segment is prevented from rotating or tipping relative to said turbine component, the method comprising:

providing an outer turbine component formed with a circumferential groove open in a forward-facing axial direction;

providing the nozzle segment including a vane extending between inner and outer bands, said outer band provided with an upstanding annular hook formed with a hook element extending in an aft-facing axial direction, said hook element received in said circumferential groove;

forming said upstanding annular hook and said hook element with a circumferentially-oriented slot;

locating an anti-rotation block in said circumferentially-oriented slot;

locating an anti-tipping plate having a circumferential width greater than a corresponding circumferential width of said circumferentially-oriented slot, over a forward face of said anti-rotation block; and securing said anti-rotation block and said anti-tipping plate directly to said outer turbine component.

11. The method of claim 10 wherein, upon installation and prior to operation, said anti-tipping plate is engaged with said upstanding annular hook but said anti-rotation block is not engaged with said upstanding annular hook.

12. The method of claim 10 wherein said upstanding annular hook includes a radially extending stem connected to said hook element, and wherein said circumferentially-oriented slot is defined by a pair of opposed parallel faces of said upstanding annular hook and a circumferentially-extending base surface formed in said stem between said pair of opposed parallel faces.

13. The method of claim 12 wherein during operation, said anti-rotation block is engaged with one of said opposed parallel faces of said upstanding annular hook.

14. The method of claim 10 and further comprising removal of a selected nozzle segment in said annular row of nozzle segments by the additional steps of:

removing the anti-rotation block and anti-tipping plate from the selected nozzle segment and at least a pair of adjacent nozzle segments;

reinstalling the anti-tipping plate on each of the selected nozzle segment and pair of adjacent nozzle segments;

rotating said selected nozzle segment to a predetermined location;

removing the anti-tipping plate of the selected nozzle segment; and removing the selected nozzle segment.

15. The method of claim 14 wherein, upon installation and prior to operation, said anti-tipping plate is engaged with said upstanding annular hook, but said anti-rotation block is not engaged with said upstanding annular hook.

16. The method of claim 14 wherein said upstanding annular hook includes a radially extending stem connected to said hook element, and wherein said circumferentially-oriented recess is defined by a pair of opposed parallel faces of said upstanding annular hook and a circumferentially-extending base surface formed in said stem between said pair of opposed parallel faces.

17. The method of claim 16 wherein during operation, said anti-rotation block is engaged with one of said opposed parallel faces on said upstanding annular hook.

18. The method of claim 10 wherein said outer turbine component comprises a shroud attached to an inner turbine shell.

19. The method of claim 18 wherein said outer turbine component comprises a turbine shell.

* * * * *

UNITED STATES PATENT AND TRADEMARK OFFICE

CERTIFICATE OF CORRECTION

PATENT NO. : 8,684,683 B2
APPLICATION NO. : 12/956554
DATED : April 1, 2014
INVENTOR(S) : Brunt et al.

It is certified that error appears in the above-identified patent and that said Letters Patent is hereby corrected as shown below:

In the Specification

Column 2, line 49, insert --12-- after "outer band"

Column 2, line 65, insert --12-- after "outer band"

Column 3, line 34, insert --32-- after "anti-rotation block"

Column 3, lines 43-44, insert --36-- after "anti-tipping plate"

Signed and Sealed this
Fifth Day of August, 2014

Michelle K. Lee

Michelle K. Lee
*Deputy Director of the United States Patent and Trademark Office*